United States Patent [19]

Kamin et al.

[11] Patent Number: 4,915,236

[45] Date of Patent: Apr. 10, 1990

[54] CARDBOARD AND PLASTIC COMPOSITE PARALLELOPIPEDAL CONTAINER FOR LIQUID

[75] Inventors: Klaus O. K. Kamin, Stuttgart; Karl-Heinz Ludwig, Julich-Broich, both of Fed. Rep. of Germany

[73] Assignee: PKL Verpackungssysteme GmbH, Dusseldorf, Fed. Rep. of Germany

[21] Appl. No.: 219,966

[22] Filed: Jul. 15, 1988

[30] Foreign Application Priority Data

Jul. 23, 1987 [DE] Fed. Rep. of Germany ... 8710092[U]
Feb. 1, 1988 [DE] Fed. Rep. of Germany ... 8801139[U]

[51] Int. Cl.[4] ..... B65D 5/74

[52] U.S. Cl. ..... 206/621.6; 206/621.3; 206/621; 229/125.42

[58] Field of Search ..... 206/621.6, 621.3, 621.2, 206/621.1, 621, 631.2; 229/125.42

[56] References Cited

U.S. PATENT DOCUMENTS 3,347,444 10/1967 Rausing et al. ..... 206/621.3
3,957,180 5/1976 Skillman ..... 206/621.3
4,301,927 11/1981 Carlsson et al. ..... 206/621.3 X

FOREIGN PATENT DOCUMENTS 0049460 4/1982 European Pat. Off. ..... 206/621.6
0130666 1/1985 European Pat. Off. ..... 206/621
1037495 7/1966 United Kingdom ..... 206/631.2

*Primary Examiner*—Stephen Marcus
*Assistant Examiner*—Jes F. Pascua
*Attorney, Agent, or Firm*—Sprung Horn Kramer & Woods

[57] ABSTRACT

A container is made out of a flat material like paper, cardboard, etc., especially a parallelopipedal container for liquid made out of a composite of cardboard and plastic. The container has a ridged-seam closure that extends along the upper surface and, continues at each side, along fold-down triangles, which can be applied against the walls of the container, and which are demarcated by scores. The scores slant from the upper edge of the walls to the ridged-seam closure, and at least one of the scores is provided with a tear-out closure, which has material-weakening lines in the area of the wall that constitutes the fold-down triangle which are arrayed in the shape of a U with a basic perforated line that parallels the base line of the ridged-seam closure and with leg-like perforated lines that extend perpendicular to the basic perforated line, which they encounter in the vicinity of the slanting scores.

9 Claims, 2 Drawing Sheets

CARDBOARD AND PLASTIC COMPOSITE PARALLELOPIPEDAL CONTAINER FOR LIQUID

BACKGROUND OF THE INVENTION

The invention relates to a container made out of a flat material like paper, cardboard, etc., especially a parallelopipedal container for liquid made out of a composite of cardboard and plastic with a ridged-seam closure that extends along the upper surface and, continuing at each side, along fold-down triangles, which can be applied against the walls of the container, which can be demarcated by scores, which have scores slanting from the upper edge of the walls to the ridged-seam closure, and at least one of which is provided with a rip-out pouring aperture comprised of material-weakening lines.

A container of this type is known from German Patent 1 298 929 for example. To facilitate opening the container, it has a material-weakening line that is produced in the still flat packaging material in the form of a V-shaped or W-shaped perforated line and that extends at an angle to the base of the closure seam. The composites usually employed to manufacture aseptic containers, however, are made out of aluminum foil and tough plastic, and the weakening line is so difficult to separate that substantial force must be applied to rip out part of the head seam along the perforated line. It would of course basically be possible to make the perforated line deeper and hence facilitate separating it. This, however, is impossible in aseptic containers because the risk of leakage would be unacceptable.

SUMMARY OF THE INVENTION

The object of the invention is to manufacture a container out of a flat material like paper, cardboard, etc., especially a parallelopipedal container for liquid and made out of a composite of cardboard and plastic with a ridged-seam closure that will be especially easy to open manually.

This object is attained in accordance with the invention by the improvement wherein the material-weakening lines in the area of the wall that constitutes the fold-down triangle are arrayed in the shape of a U with a basic perforated line that parallels the base line of the ridged-seam closure and with leg-like perforated lines that extend perpendicular to the basic perforated line, which they encounter in the vicinity of the slanting scores. Once a container of this type has been folded up and sealed, the perforated lines will coincide, making it comparatively easy to open. It can in fact be opened simply by folding up the fold-down triangle, bending the forward peak of the triangle back and forth a few times along the material-weakening line, and tearing it off.

The peak of the triangle can be torn off with relatively little force because the perforated lines have been preliminarily folded 180° in both directions. Since the container does not need to be deformed to open it, both its corner rigidity and hence its resistance to crushing are completely retained. The pouring aperture obtained as previously described herein or the punched-out spout has a comparatively obtuse angle of friction that allows reliable, dripless, and oriented pouring. Gushing can be eliminated by providing a ventilating hole on the side of the container opposite the pouring aperture. Once the container has been partly emptied, the pouring spout can be folded back against the wall, providing a simple way of reclosing the container.

Due to the special situation and design of the perforated line, it can be embodied in various ways, by perforating all the way through the uncoated base of cardboard or other material for instance or by punching or stamping half way through the coated composite from outside. The coincidence of the perforated lines in the fold-down triangle and along the direction that the packaging material travels in the folding, filling, and sealing machine ensures a simple and sharply demarcated heat treatment that improves the adhesion of the layers in the vicinity of the perforated lines.

The pouring aperture will be particularly satisfactory when the basic perforated line is situated approximately half way up the altitude of a triangle demarcated by the edge of the wall and the slanting scores.

Deviations in register and margins dictated by manufacturing conditions sometimes lead to displacement of the perforated lines in relation to the scores, and hence result in problems in opening the container in that the perforated lines no longer coincide.

To facilitate opening the container even when the perforated lines do not coincide, the perforated lines in one practical embodiment of the invention are angled or curved at the mutually opposing corners. The advantage of this embodiment of the perforated line is that the point of departure for ripping into and tearing off the corner of the container is always on the scores even when the perforated lines are displaced thereto.

Furthermore the preliminary back-and-forth bending will weaken the corner more effectively in that the curved path of the perforated line in the vicinity of the corners will—in terms of the finally shaped container—apply more stress to the perforated line.

The length of the radius of curvature depends on both the format of the container and on the basic dimensions of the pouring aperture, meaning that the larger the basic dimension, the longer the radius can be, and on the extent of the deviations that are to be compensated, meaning that the greater the deviations the greater the radius must be, the only limitations being that too long a radius will impede opening due to too much stress and that too short a radius will not compensate for the deviations.

To facilitate bending and tearing into the cover of the container, $$R = L/4 \text{ to } L/8 \text{ and preferably } R = L/6,$$

where R is the radius and L is the length of the base line. Thus, if the base line is 30 mm long, the radius will be 7.5 to 3.75 and preferably 6 mm long.

This ratio will compensate for any range of deviations that normally occurs in practice.

Preferred embodiments of the invention will now be specified with reference to the drawings, wherein

DETAILED DESCRIPTION OF THE INVENTION

Figure 1:
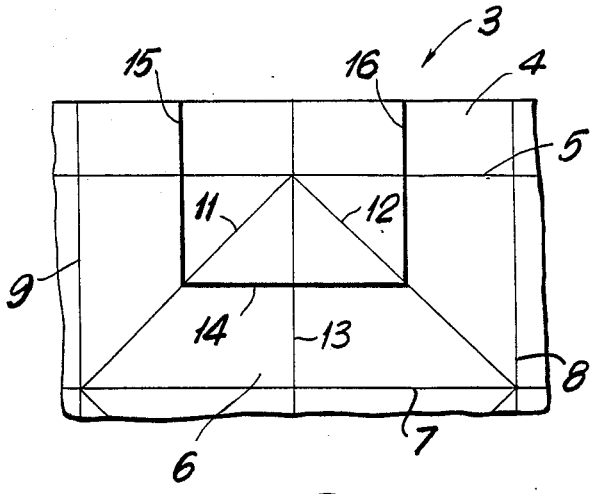
FIG. 1 shows the vicinity of the ridged-seam closure and fold-down triangle in a blank according to the invention suitable for manufacturing a container, FIG. 2 schematically illustrates the first step in opening the container, FIG. 3 schematically illustrates the opened container.
Figure 2:
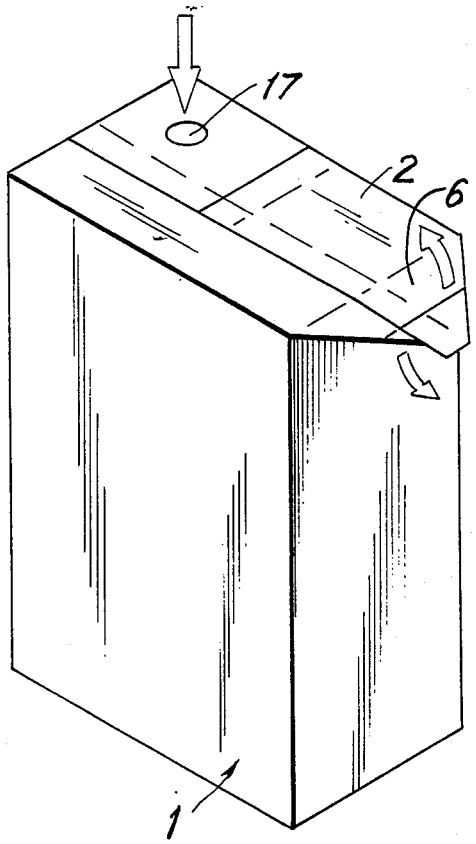
Figure 3:
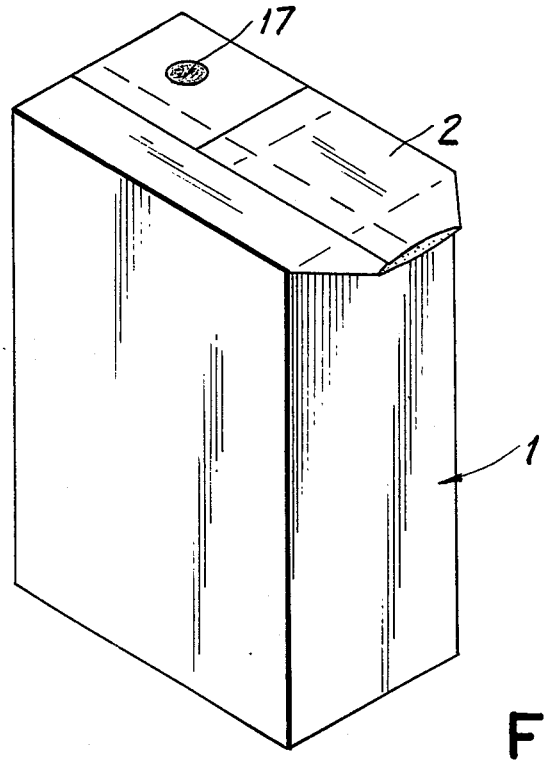

Referring to FIGS. 1–3, the container with walls 1, a top 2, and a base illustrated in FIG. 2 is manufactured from a flexible but relatively rigid web of material in the form of a blank 3 for example, part of which is illustrated in FIG. 1. The container is manufactured by introducing the blank into a tubular mold, closing it with a longitudinal and a bottom seam, and sealing it with a ridged-seam closure 4 at the top. Closure 4 is demarcated from the material in walls 1 by a base line 5. There are triangles 6 that can be folded down and against the wall of the container at each end of the top. Each fold-down triangle 6 is folded down around the edge 7 of one wall and secured by an easily released adhesive to the adjacent wall. Ridged-seam closure 4 extends through fold-down triangle 6, through top 2, and through the opposite triangle, which is unillustrated and has been folded down against the opposite wall, invisible in the drawing, of the container. The container also has scores 8 and 9 and 11, 12, and 13. Scores 8 and 9 demarcate the transitions between two adjacent walls 1 and scores 11, 12, and 13 are in the vicinity of fold-down triangle 6. Scores 11 and 12 are at an angle to each other and constitute, in conjunction with the edge 7 of the wall, a triangle. Score 13 extends along the altitude of the triangle.

The container is provided with material-weakening lines to facilitate opening it. The material-weakening lines in the area of the wall that constitutes the triangle are in the shape of a U and consist of a basic perforated line 14 that parallels the base line 5 of ridged-seam closure 4 and of two leg-like perforated lines 15 and 16 that encounter basic perforated line 14 at slanting scores 11 and 12.

When a container is manufactured out of a blank that has been perforated in this way, perforated lines 14, 15, and 16 will coincide along the inside and outside of the triangle, which will accordingly be dissected into two sections paralleling the edge 7 of the wall by the perforated line. The container is opened by folding the triangle up, bending the forward peak of the triangle back and forth 180° in both directions, and tearing it off. It will then only be necessary to punch out a ventilating hole 17 at the opposite end of top 2 to allow the contents of the package to be poured out without gushing. Since the package does not need to be deformed, forced in at the corners, that is, while it is being ripped open, it will retain its corner rigidity and hence its resistance to crushing. Once the container has been partly emptied, the spout that has been created as previously described herein can be folded back down against the wall of the container, partly resealing it.

Figure 4:
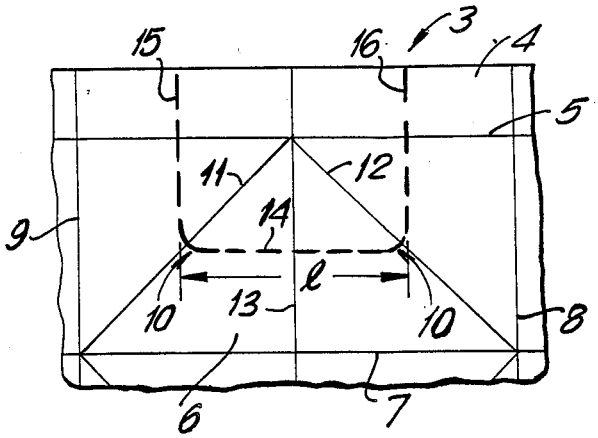
FIG. 4 shows the vicinity of the ridged-seam closure and fold-down triangle in a blank according to the invention suitable for manufacturing a container, with different material-weakening lines.
Figure 5:
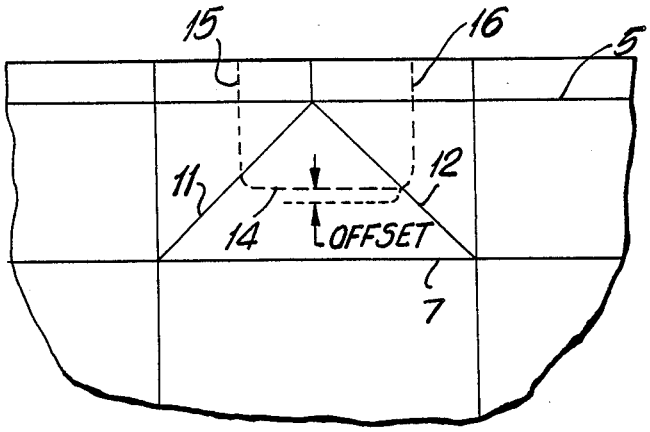
FIGS. 5 and 6 illustrate embodiments similar to that illustrated in FIG. 4 but with displaced perforated lines.
Figure 6:
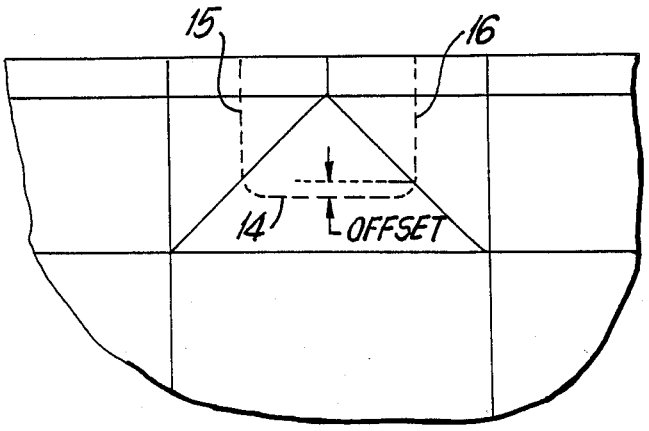

In the event that the perforated lines are displaced due to manufacturing tolerances as illustrated in FIGS. 5 and 6, the container will still be easy to open in that an angle or curve 10 in the vicinity of the corner and between perforated lines 14, 15, and 16 will always coincide with slanting scores 11 and 12 as shown in FIG. 4. This measure always ensures a point of departure at the scores for ripping into and tearing off the edge of the container. Furthermore, the particular curvature employed will always apply more stress to the perforations, making the destruction of the corner that results from bending it back and forth more effective.

The larger the container or the basic dimensions of the perforated lines, the more extensive angle or curve 10 should be.

The radius of curvature should more or less equal the maximum expected extent of deviation.

It has been proven practical for $$R = L/4 \text{ to } L/8 \text{ and preferably } R = L/6$$

where L is the length of the base of the opening and R the radius.

What is claimed is:

1. In a parallelopipedal container for liquid formed from a blank composed of a composite of cardboard and plastic with a ridged-seam closure having a base line and that extends along the upper surface and continues at each side along fold-down triangles, disposed against walls of the container, wherein the triangles are demarcated by scores slanted from an upper edge of the walls to the ridged-seam closure, and at least one of the fold-down triangles is provided with a rippable pouring aperture comprising material-weakening lines, the improvement wherein the material-weakening lines in the area of one fold-down triangle are U-shaped on the blank with a basic line that parallels the base line of the ridged-seam closure and with leg-like lines that extend perpendicular to the basic line and encounter same in the vicinity of the slanting scores and wherein the basic and leg-like lines are connected at each corner by a curve.

2. The container as in claim 1, wherein a triangle demarcated by an edge of a wall and the slanting scores has an altitude and wherein the basic line is disposed approximately half way up the altitude of the triangle demarcated by said edge of a wall and the slanting scores.

3. The container as in claim 1, wherein the basic and leg-like lines comprise a halfway incision that only partly separates the composite of cardboard of the container.

4. The container as in claim 1, wherein the radius of the curve is a function of the dimensions of the U-shaped lines.

5. The container as in claim 4, wherein the material-weakening lines deviate when the triangles are folded against the walls of the container and wherein the radius is approximately no less than the deviation.

6. The container as in claim 5, wherein $R = L/4$ to $L/8$, wherein L is the length of the basic line and R is the radius of the curve.

7. The container as in claim 6, wherein $R = L/6$.

8. The container as in claim 1, wherein a triangle demarcated by an edge of a wall and the slanting scores has an altitude and wherein the basic line is disposed about halfway up the altitude of the triangle demarcated by said edge of a wall and the slanting scores.

9. The container as in claim 1, wherein the basic and leg-like lines comprise a halfway incision that only partly separates the composite of cardboard of the container.

* * * * *